US008286377B2

(12) United States Patent
Uy

(10) Patent No.: US 8,286,377 B2
(45) Date of Patent: Oct. 16, 2012

(54) DYNAMIC DISPLAY SIGNAGE SYSTEM

(75) Inventor: Rafael Q. Uy, Imus Cavite (PH)

(73) Assignee: Media Pool Incorporated, Mandaluyong (PH)

( * ) Notice: Subject to any disclaimer, the term of this patent is extended or adjusted under 35 U.S.C. 154(b) by 222 days.

(21) Appl. No.: 12/921,706

(22) PCT Filed: Mar. 13, 2009

(86) PCT No.: PCT/PH2009/000002

§ 371 (c)(1),
(2), (4) Date: Sep. 9, 2010

(87) PCT Pub. No.: WO2009/113885

PCT Pub. Date: Sep. 17, 2009

(65) Prior Publication Data

US 2011/0041369 A1 Feb. 24, 2011

(30) Foreign Application Priority Data

Mar. 13, 2008 (PH) ..... 1-2008-000084

(51) Int. Cl.
*G09F 11/08* (2006.01)

(52) U.S. Cl. ..... 40/470; 40/514

(58) Field of Classification Search ..... 40/470, 40/471, 514–517, 601; 242/538.1, 538
See application file for complete search history.

(56) References Cited

U.S. PATENT DOCUMENTS 3,616,554 A * 11/1971 Singer et al. ..... 40/471
3,726,031 A * 4/1973 Singer ..... 40/471
4,677,779 A * 7/1987 Rodriguez ..... 40/514

FOREIGN PATENT DOCUMENTS

GB 2211481 A * 7/1989

* cited by examiner

*Primary Examiner* — Casandra Davis
(74) *Attorney, Agent, or Firm* — Notaro, Michalos & Zaccaria P.C.

(57) ABSTRACT

The present invention relates to a dynamic display signage system comprising a supporting means, a substantially pliable display panel being secured in a substantially vertical manner on said supporting means, and a primary drive means to allow the upward and downward vertical displacement of said display panel along said supporting means, characterized in that said display panel being provided with a secondary drive means operatively connected at the lower portion thereof, said secondary drive means having an independent motion with respect to said primary drive means to allow a consequent independent motion of said display panel at a pre-selected tension in order to maintain the consistent viewable surface integrity of the said display panel as it is vertically displaced.

18 Claims, 8 Drawing Sheets

DYNAMIC DISPLAY SIGNAGE SYSTEM

FIELD OF THE INVENTION

The present invention relates in general to display or advertising systems having a display banner, printed contents thereof being dynamically displayed by the movement of driving means such as a pulley and winch assembly or an elevator carriage, but more particularly to an advertising system provided with a special drive system to maintain a consistent viewable surface integrity of the display banner as the drive means accelerates and decelerates, and thus effectively maintaining a consistently readable display item on the display banner.

BACKGROUND OF THE INVENTION

Conventional display systems particularly used for advertising purposes employ mechanical or electronic devices to facilitate the changing of the visual presentation of the advertisement item.

Attempts to provide a dynamic display system specifically for advertising purposes using an elevator cab as the primary driving means to allow a pliant display panel to be vertically displaced in upward and downward direction along a vertical path have been made as can be gleaned from the elevator display system shown in U.S. Pat. No. 4,677,779. Briefly, U.S. Pat. No. 4,677,779 features a display system comprising an elevator cab, an elevator shaft, a motor drive connected to the elevator shaft, and a display banner secured at the lower portion of the elevator cab. The display banner or panel is provided with display items printed on the surface portion thereof and its bottom end is wound about to a spring-loaded drum provided at the lower end portion of the elevator cab.

During the vertical movement of the elevator cab, the display banner of the aforementioned prior art tends to slack off or get loose primarily due to the wind load and the non-uniform accelerating and decelerating motion of the elevator cab. This technical problem tends to aggravate as the display banner is lifted at higher vertical distances. As the banner slacks off, the surface integrity thereof tends to distort and hence the visual distortion of the printed advertisement items or information in the banner which render the same unreadable.

The features of the prior art do not address the aforementioned technical problems of elevator display systems. Moreover, at higher vertical levels the wind load becomes higher and thus resulting in a more distorted and non-readable presentation of the printed contents of the display panel. This technical problem becomes more visible when the display panel is installed outdoor and allowed to be displaced vertically by a drive means such as a pulley and motor assembly in a manner substantially similar to the use of an elevator cab as the drive means as previously discussed.

SUMMARY OF THE INVENTION

To overcome the aforementioned technical problem of existing display system as previously discussed, it is the main object of the present invention to provide for a dynamic display signage system that is capable of effectively maintaining the a consistent viewable surface integrity of the display panel, preferably a pliant banner with advertising items being provided thereon, and thus allow the consistent readability of the advertisement items or information contained thereon and allow for a more dramatic visual impact.

The herein display signage system of the present invention comprising a supporting means, a substantially pliable display panel being secured in a substantially vertical manner on said supporting means, and a primary drive means to allow the upward and downward vertical displacement of said display panel along said supporting means, characterized in that said display panel being provided with a secondary drive means operatively connected at the lower portion thereof, said secondary drive means having an independent motion with respect to said primary drive means to allow a consequent independent motion of said display panel at a preselected tension in order to maintain the consistent viewable surface integrity of the said display panel as it is vertically displaced. The primary drive means can be a pulley or winch assembly or an elevator carriage such as a panoramic elevator.

Another object of the present invention is to provide for a dynamic display signage system using an elevator carriage, such system comprises of a pair of display panels disposed at the upper and lower portions of the elevator carriage to allow a more dynamic and simultaneous display of the advertisement items contained thereon.

Still, another object of the present invention is to provide for a dynamic display signage system having a display panel with a drive system independent to the drive system of the elevator carriage, thus avoiding physical contact between the drive system of the elevator and the display panel. In this manner the transfer of the factor of safety in the elevator to the display panel is prevented.

These and other objects and advantages of the present invention will become apparent upon a reading of the ensuing detailed description taken in conjunction with the appended drawings.

BRIEF DESCRIPTION OF THE DRAWINGS

FIG. 6 is a schematic diagram showing an example of second motor and its operation together with the spool member;

DETAILED DESCRIPTION

Figure 1:
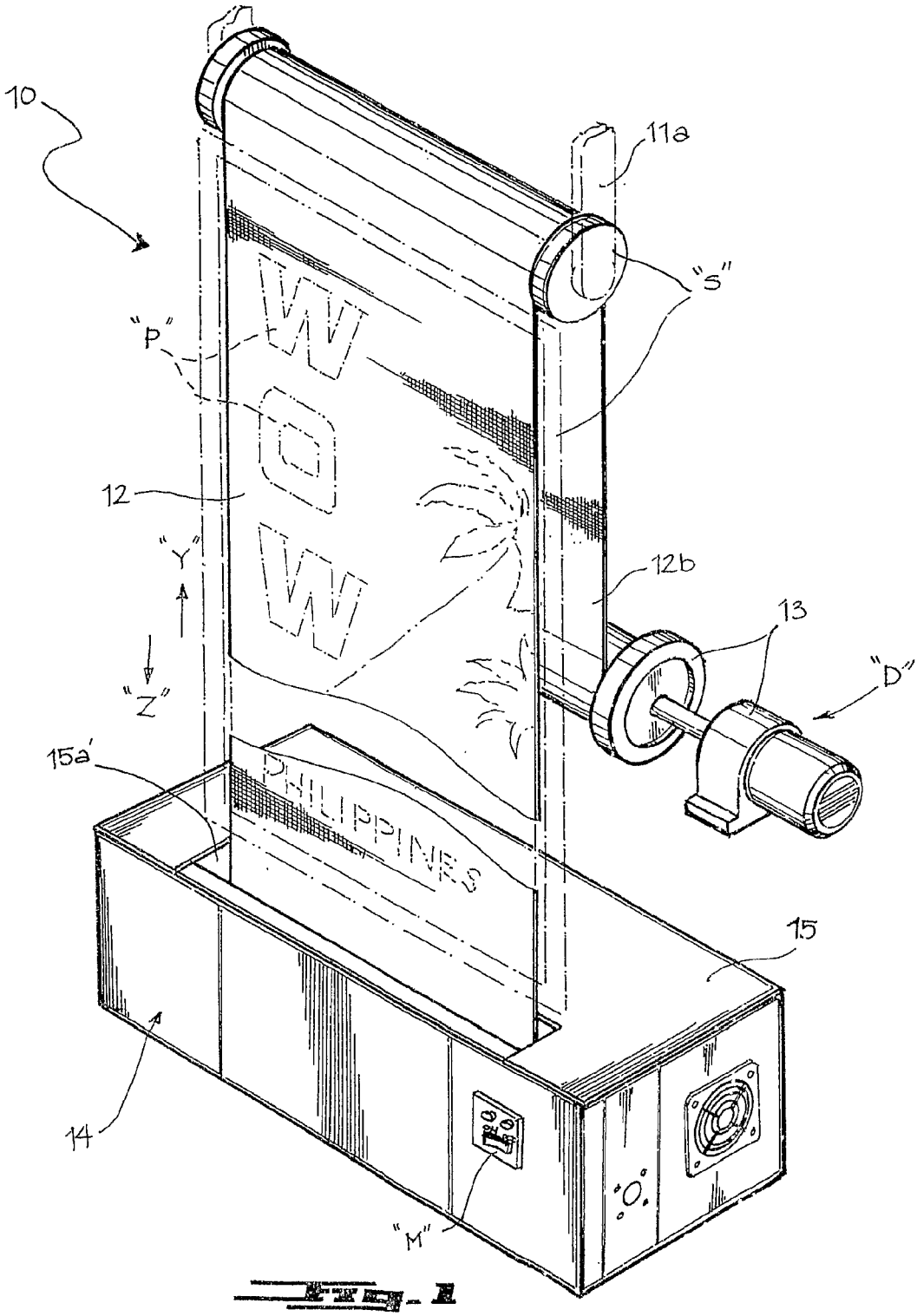
FIG. 1 is a perspective showing the present invention for a dynamic display signage system.

Before describing a preferred embodiment of the invention in detail, it is to be understood that the phraseologies and terminologies used herein are for the purposes of description and should not be regarded as limiting.

Referring now to the different views of the drawings, wherein like reference numerals designate same parts throughout the ensuing enabling description, there is shown the present invention for a dynamic display signage system designated as 10.

Display signage system 10 basically comprises a supporting means "S", a substantially pliable display panel 12 being secured in a substantially vertical manner on the supporting means and provided with display items (contents) "P" on the surface portion thereof, and a primary drive means "D" to allow the upward and downward vertical displacement of display panel 12 along the supporting means "S". Preferably, in such a system 10, supporting means "S" are defined by frame 11*a* and the primary drive means "D" is a winch and pulley assembly 13.

In accordance with the present invention as shown in FIG. 1, the display panel 12 is provided with a secondary drive means 14 operatively connected at the lower portion thereof. Secondary drive means 14 has an independent motion with respect to primary drive means 13 to allow a consequent independent motion of the display panel 12 at a pre-selected tension in order to maintain the consistent viewable surface integrity of the display panel 12 as it is vertically displaced. The consistency of the viewable surface integrity of the display panel 12 is greatly affected by wind forces and other contributory forces that tend to distort and bend the display panel 12. The herein display panel 12 which is preferably made of flexible materials such as a tarpaulin or a banner when installed at higher vertical heights tend to easily bend as caused by the stronger wind forces at higher vertical levels. When the display panel 12 bends, the printed matters or advertising items contained therein tend to distort resulting to an unclear or a blurred and non-readable presentation of the advertising items printed on the surface of the display panel 12.

To maintain the consistent viewable surface integrity of such display panels 12 even at vertical heights such as 20 meters or more, the present invention features a mechanism as defined by a second drive means 14 and will now be described in the succeeding description.

Figure 2:
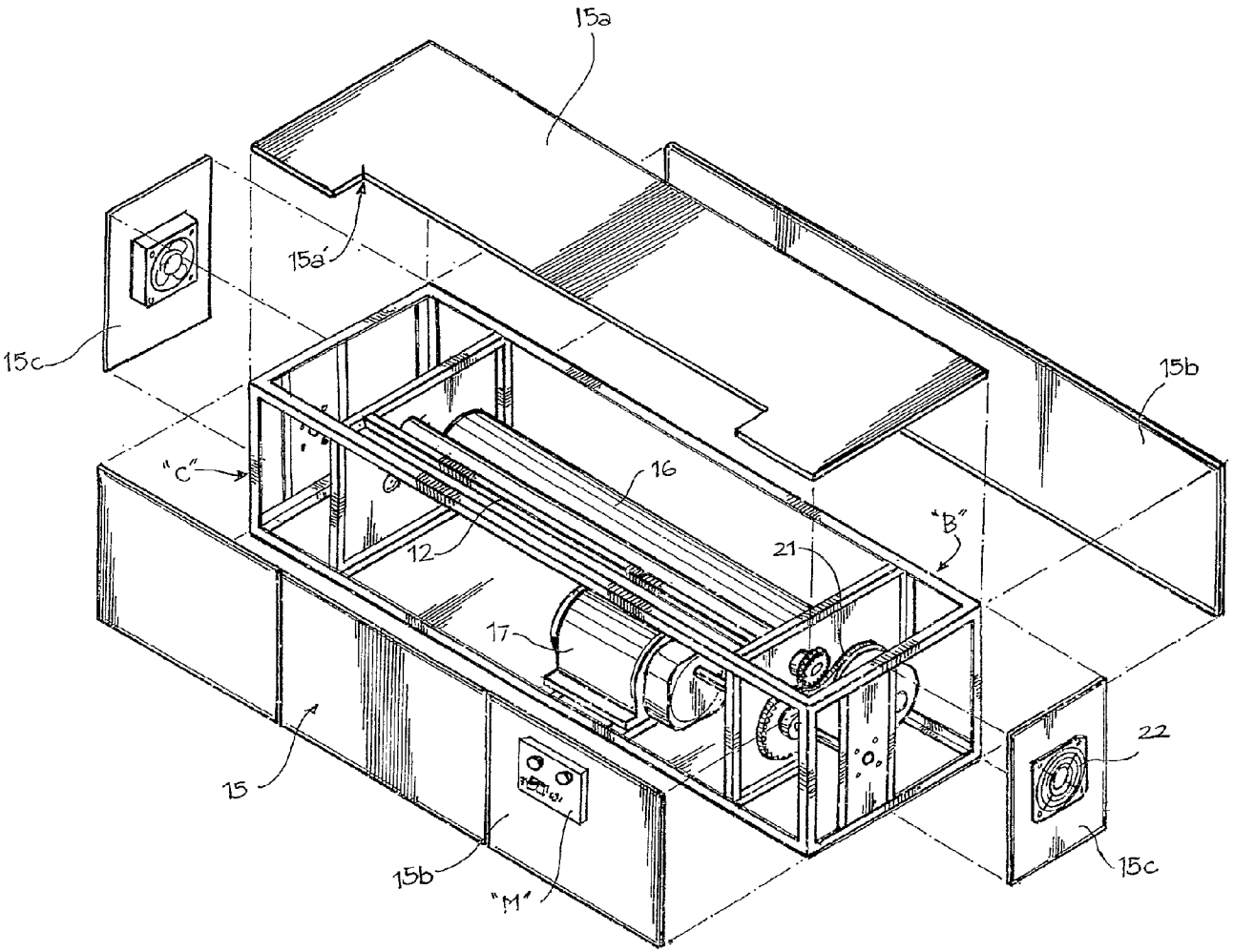
FIG. 2 is an exploded view of the preferred embodiment of the second drive means of the present invention.

Referring now to FIG. 2, the second drive means 14 comprises of a housing 15 having a top wall 15*a* with a slot portion 15*a*', side walls 15*b*, opposed end walls 15*c* and a bottom wall.

Figure 3:
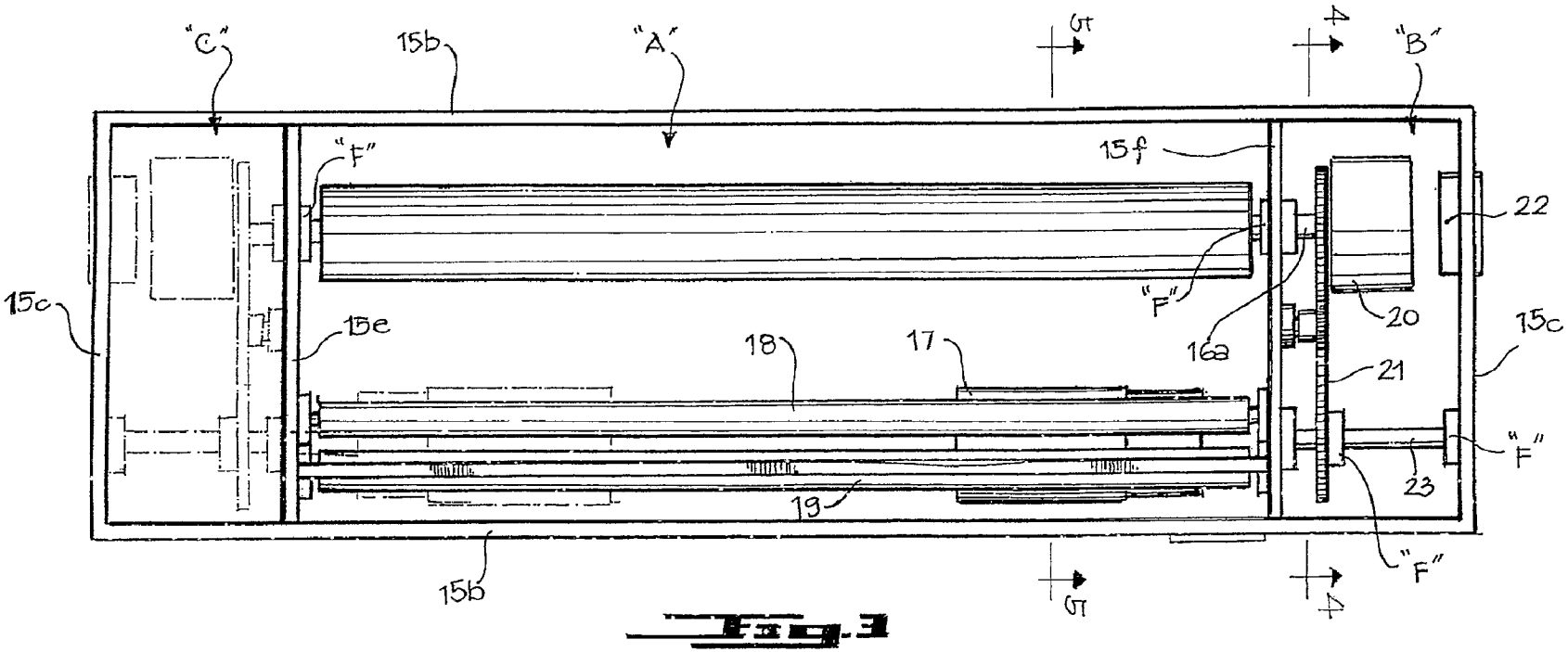
FIG. 3 is an open top view of said second drive means.
Figure 4:
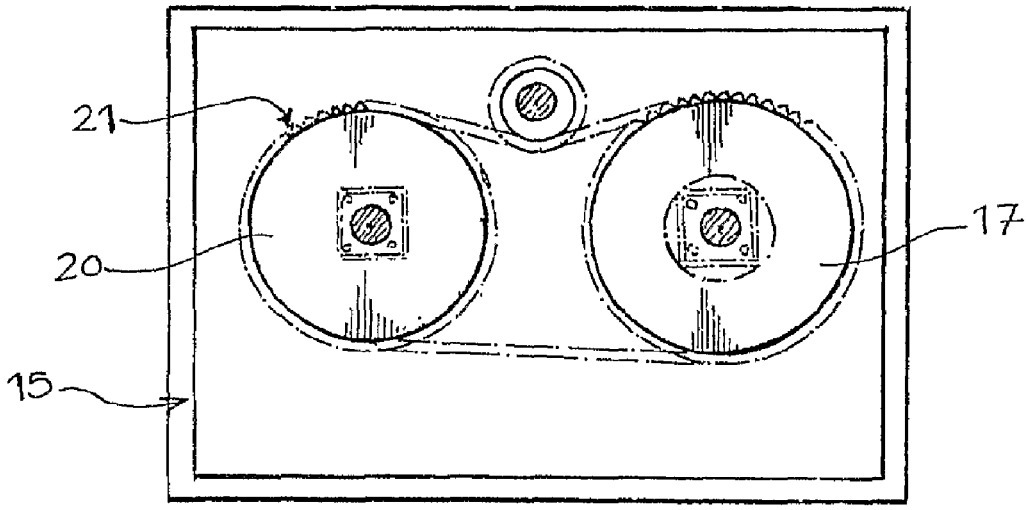
FIG. 4 is sectional vie taken along line 4-4 of FIG. 3.
Figure 5:
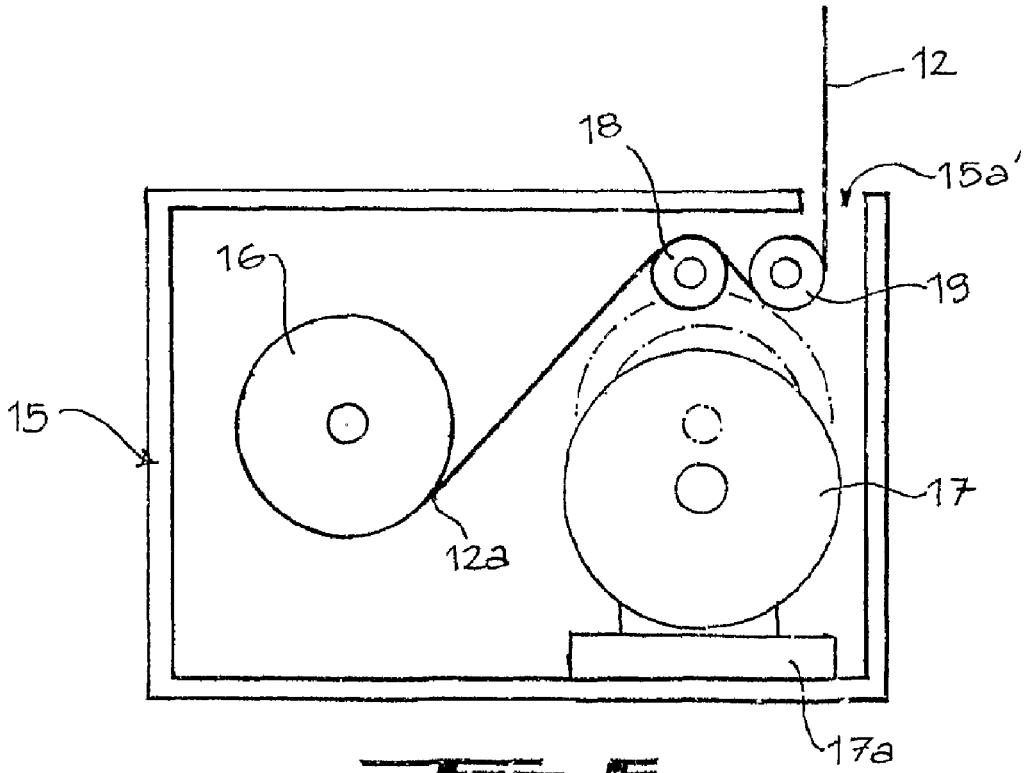
FIG. 5 is sectional vie taken along line 5-5 of FIG. 3.
Figure 5:
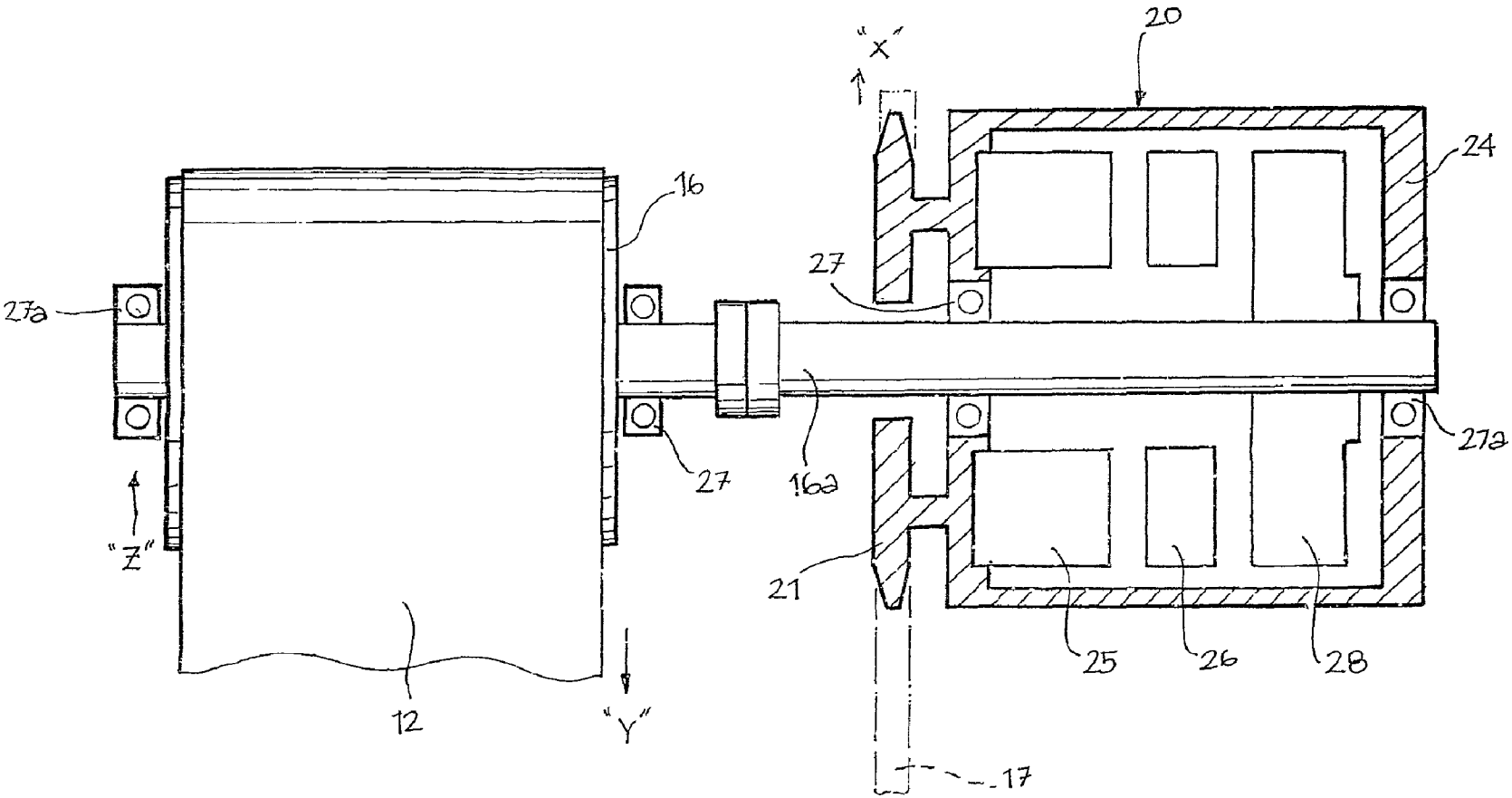

As further shown in FIGS. 2 and 3, housing 15 is further formed by a spool section "A" and at least an auxiliary motor section "B" disposed contiguously with the spool section "A". Another auxiliary motor section "C" which is identical to auxiliary motor section "B" may be provided as a redundant system to function as a reserve motor or allowed to function alternately with the auxiliary motor section "B".

In a preferred embodiment according to the present invention as shown in FIGS. 2 and 3, spool section "A" comprises of a spool member 16 having a shaft 16*a* extending to the auxiliary motor section "B", a first motor 17 secured parallel to the spool member 16 and supported by a base 17*a*, and at least a pair of guide rollers 18 and 19 provided above first motor 17 and adapted to feed the display panel 12 from the spool member 16 towards the slot portion 15*a*' of the top wall 15*a*. The spool member 16 is supported between the inner walls 15*e* and 15*f* by flange bearings "F". A main control switching panel "M" is provided on side wall 15*b* preferably at a proximate distance to the first motor 17.

The spool member 16 is further provided with means to secure the lower portion 12*a* of the display panel 12. Such means could preferably be a slot provided along the longitudinal section of the spool member 16 where the lower edge of the display panel 12 is securely fastened by fastening means such as a wire, clip, screw or the like.

Referring again to FIGS. 2 and 3, the auxiliary motor section "B" and "C" comprises of a second motor 20 directly coupled to the first motor 17 which is disposed in the spool section "A" via a means to transfer speed such as a chain and sprocket assembly 21 or a pulley assembly (not shown). The second motor 20 has a independent motion with respect to the primary drive "D" and has preferably a uniform motion in a clockwise direction. The second motor 20 is further coupled to the spool member shaft 16*a* of the spool member 16 to provide the display panel 12 an independent motion with respect to the primary drive means "D" at a pre-selected tension in order to maintain the consistent viewable surface integrity of the display panel 12 and its contents "P" as it is vertically displaced. A cooling system, preferably a fan 22 having an operating system connected to the main control switching panel "M" is also provided within said auxiliary motor sections "B" and "C".

Referring again to FIG. 3, the chain and sprocket assembly 21 is supported by shaft 23 extending from the first motor 17. The shaft 23 is supported by opposed flange bearings "F" provided within the auxiliary motor sections "B" and "C".

Housing 15 is preferably provided with electronic sensor and relay switches which are electronically configured with the first and second motors and provided with switching controls in the main control panel "M". The sensors triggers the redundant system either to allow the use of the other motor section when the current motor section in use becomes inoperable or allow for the alternate operation of the motor sections at a pre-selected interval of time.

In operation, the display panel 12 together with printed advertising contents as desired is installed as shown in FIG. 1. The lower portion 12*a* of the display panel is secured to the spool member 16 and the upper portion 12*b* to the primary drive means "D", particularly the pulley and winch assembly 13.

Referring now to FIG. 6, by means of the main control switching panel "M", the primary drive means "D" is now switched-on to either displace the display panel in the "Y" direction (upwardly) or "Z" direction (downwardly) along the supporting means "S". At the same time, the first motor 17 is also switched-on to drive the secondary motor 20 independent to the drive means "D" and in uniform clockwise "X" direction.

A pre-selected tension is provided so that the independent motion is a uniform counter pulling motion by the second motor 20 against the primary drive means "D" when the display panel 12 is upwardly displaced, and another independent motion is a downward vertical pulling motion by the second motor 20 when the display panel 12 is downwardly displaced, the downward vertical motion is faster than the applied motion of said primary drive means "D" on the display panel 12. In both conditions, a consistent viewable surface integrity is thus efficiently attained.

Preferably, as shown in FIG. 6, the second motor 20 is formed by a motor housing 24, a first magnet 25, and buffer 26. The spool shaft 16*a* is held and extends within the second motor 20 by ball bearings 27, 27*a*, and a second magnet 28 is secured on the shaft 16*a* and in direct magnetic relation to the first magnet 25 and which both magnets are capable of inducing a magnetic field.

The buffer 26 is first calibrated to a desired pre-selected tension which is the approximate tension to maintain the viewable surface integrity (flatness) of the display panel 12. The first motor 17 is then operated to allow the chain and sprocket assembly 21 to rotate clockwise together with the first magnet and buffer 26, such rotation being independent of the rotation of the primary drive means "D". During the vertical displacement of the display panel 12, and at a pre-selected tension, the first magnet 25 and second magnet 28 magnetically attract with each other via buffer 26 and thus causing the shaft 16*a* to rotate in the direction of second motor 20 and produce a uniform counter rotation against the "Y" direction of the primary drive means "D". In this manner, a consistent viewable surface integrity of the display panel 12 is attained when the same is displaced in an upwardly vertical "Y" direction.

Figure 7:
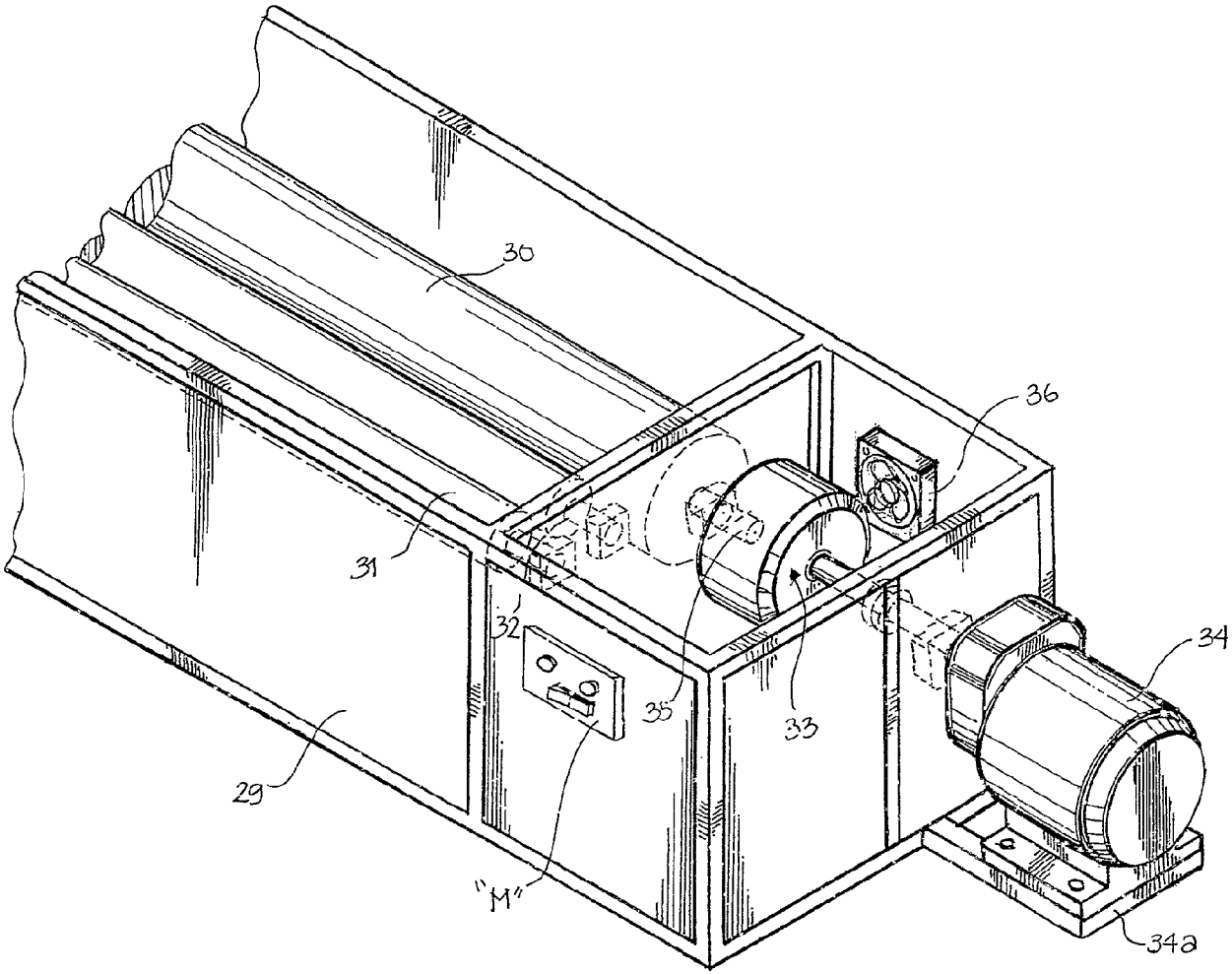
FIG. 7 shows an alternative embodiment of the present invention.

In another embodiment of the present invention as shown in FIG. 7, a housing 29 is provided with a spool section A comprising a spool member 30 having a shaft 31 extending to an auxiliary motor section B, spool member 30 having means to secure the lower portion of said display panel 12, and at least a pair of guide rollers 31 and 32 adapted to feed the display panel 12 from the spool member 30 towards a slot portion provided on the top wall of the housing.

Further in this embodiment, the auxiliary motor section B comprises of a second motor 33, a first motor 34 having a base 34*a* directly coupled to the second motor 33 and having an independent counter motion with respect to the primary drive means "D". The second motor 33 is further coupled to the spool member shaft to provide the display panel 12 an independent motion with respect to the primary drive means "D" at a pre-selected tension, and a cooling system 36 provided within said auxiliary motor section. In this embodiment, the chain and sprocket assembly is not anymore needed and the first motor is direct connected to the second motor 33. This set-up functions in the same way as the preferred the embodiment shown in FIGS. 2 and 3 and as previously discussed.

Figure 8:
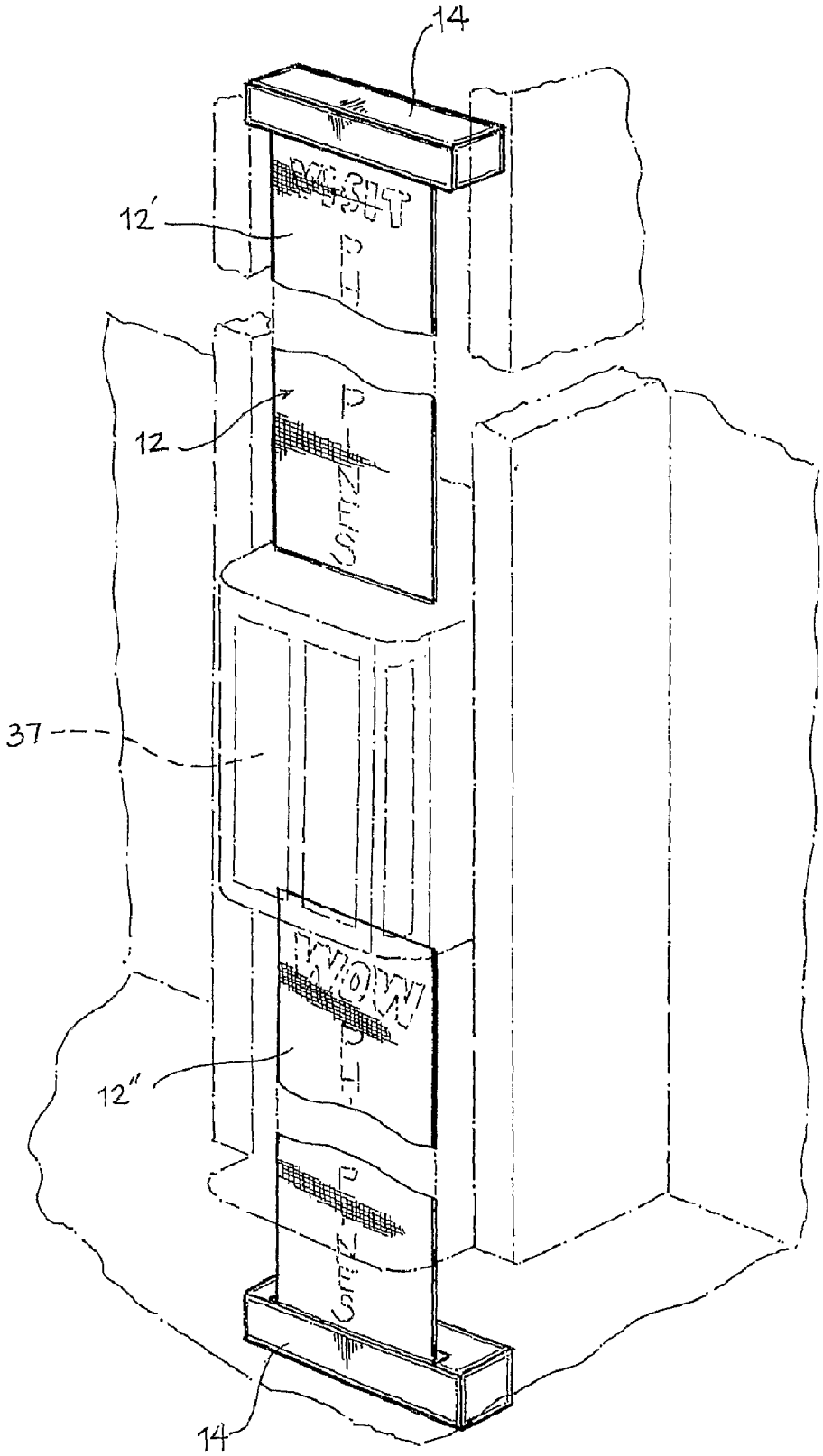
FIG. 8 shows another alternative embodiment of the present invention.
Figure 9:
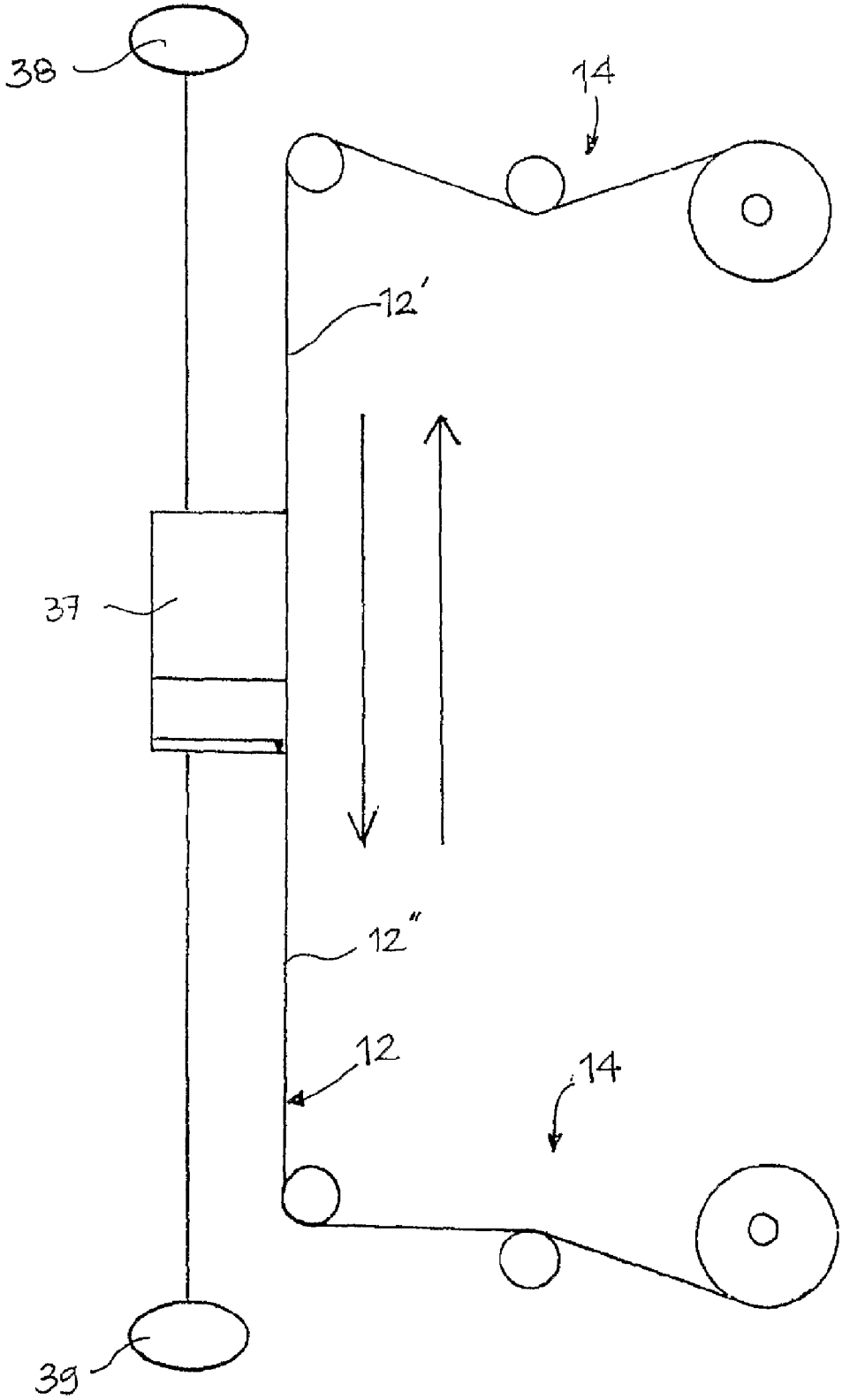
FIG. 9 is a schematic diagram of the operation of the alternative embodiment shown in FIG. 8.

Still, in another embodiment according to present invention as shown in FIGS. 8 and 9, an elevator carriage 37 is used as the primary drive means to displace the display panel 12 in an upward and downward vertical direction. The herein embodiment comprising an elevator carriage 37 being moveable on selective vertical positions, a substantially pliable display panel 12 being secured on at least one end portion of the elevator carriage 37 to allow the vertical displacement thereof as the elevator moves, and a primary drive such as motors 38 and 39 to allow the selective vertical movement of said elevator carriage 37. Provided at the end portions of the upper and lower display panels 12' and 12" is the secondary drive means 14. The free end portions of each display panels are secure dot the upper and lower portions 37*a* and 37*b* of the elevator carriage 37.

Additional advantages and modifications of the present invention will readily occur to those skilled in the art in view of these teachings. The present invention in its broader aspects is not limited to the specific details, representative contrivances, and illustrative examples shown and described herein. Accordingly, various modifications may be made without departing from the spirit and scope of the general inventive concept as defined in the append claims and their equivalents.

The invention claimed is:

1. A dynamic display signage system comprising: a supporting means, a substantially pliable display panel being secured in a substantially vertical manner on said supporting means, and a primary drive means for driving said display panel upward and downward in vertical displacement along said supporting means, said display panel being provided with a secondary drive means operatively connected at a free end portion thereof, said secondary drive means having an independent motion with respect to said primary drive means to allow a consequent independent motion of said display panel at a pre-selected tension in order to maintain the consistent viewable surface integrity of the said display panel as it is vertically displaced.

2. A dynamic display signage system according to claim 1, characterized in that said secondary drive means comprising a housing having a top wall with a slot portion, side and bottom walls, said housing further having a spool section and at least an auxiliary motor section disposed contiguously with said spool section.

3. A dynamic display signage system according to claim 2, characterized in that said spool section comprising a spool member having a shaft extending to said auxiliary motor section, said spool member having means to secure the lower portion of said display panel, a first motor secured parallel to said spool member, and at least a pair of guide rollers provided above said first motor and adapted to feed said display panel from said spool member towards said slot portion of said top wall.

4. A dynamic display signage system according to claim 2, characterized in that said auxiliary motor section comprising a second motor directly coupled to said first motor by a speed transferring means and having an independent uniform counter motion with respect to said primary drive means, said second motor being further coupled to said spool member shaft to provide said display panel an independent motion with respect to said primary drive means at a pre-selected tension in order to maintain the consistent viewable surface integrity of the said display panel as it is vertically displaced, and a cooling system provided within said auxiliary motor section.

5. A dynamic display signage system according to claim 1, characterized in that said secondary drive means comprising a housing having a top wall with a slot portion, side and bottom walls, said housing further having a spool section and a pair of auxiliary motor sections disposed contiguously with said spool section, said housing being provided with an electronic sensor to allow the use of the one of said pair of auxiliary motor sections when the other of said pair of auxiliary motor in use becomes inoperable.

6. A dynamic display signage system according to claim 5, characterized in that said housing is further provided with a relay sensor switch to allow for alternate operation of the auxiliary motor sections at a preselected interval of time.

7. A dynamic display signage system according to claim 2, characterized in that said spool section comprising a spool member having a shaft extending to said auxiliary motor section, said spool member having means to secure the lower portion of said display panel, and at least a pair of guide rollers adapted to feed said display panel from said spool member towards said slot portion of said top wall.

8. A dynamic display signage system according to claim 2, characterized in that said supporting means comprising first motor and a second motor, said first motor directly coupled to said second motor and having an independent counter motion with respect to said primary drive means, said second motor being further coupled to a spool member shaft to provide said display panel said independent motion with respect to said primary drive means at a preselected time, and a cooling system provided within said auxiliary motor section.

9. A dynamic display signage system according to claim 1, characterized in that said independent motion is an continuous counter pulling motion when said display panel is upwardly displaced and said independent motion is a downward vertical motion when said display panel is downwardly displaced, said downward vertical motion is faster than the applied motion of said primary drive means on said display panel.

10. A dynamic display signage system comprising: an elevator carriage being moveable on selective vertical positions, a substantially pliable display panels being secured on at least one end portion of said elevator carriage to allow the vertical displacement thereof as the elevator moves, and a primary drive means for driving said display panel upwardly and downwardly for vertical movement of said elevator carriage, said display panel being provided with a secondary drive means operatively connected on the free end portion thereof, said secondary drive means having an independent motion with respect to said primary drive means to allow a consequent independent motion of said display panel at a pre-selected tension in order to maintain the consistent viewable surface integrity of the said display panel as it is vertically displaced.

11. A dynamic display signage system according to claim 10, characterized in that said secondary drive means comprising a housing having a top wall with a slot portion, side and bottom walls, said housing further having a spool section and at least an auxiliary motor section disposed contiguously with said spool section.

12. A dynamic display signage system according to claim 11, characterized in that said spool section comprising a spool member having a shaft extending to said auxiliary motor section, said spool member having means to secure the lower portion of said display panel, a first motor secured parallel to said spool member, and at least a pair of guide rollers provided above said first motor and adapted to feed said display panel from said spool member towards said slot portion of said top wall.

13. A dynamic display signage system according to claim 11, characterized in that said auxiliary motor section comprising a second motor directly coupled to said first motor by speed transferring means and having an independent counter motion with respect to said primary drive means, said second motor being further coupled to said spool member shaft to provide said display panel an independent motion with respect to said primary drive means at a pre-selected tension in order to maintain the consistent viewable surface integrity of the said display panel as it is vertically displaced, and a cooling system provided within said auxiliary motor section.

14. A dynamic display signage system according to claim 10, characterized in that said secondary drive means comprising a housing having a top wall with a slot portion, side and bottom walls, said housing further having a spool section and a pair of auxiliary motor sections disposed contiguously with said spool section, said housing being provided with an electronic sensor to allow the use of the one of said pair of auxiliary motor sections when the other of said pair of auxiliary motor in use becomes inoperable.

15. A dynamic display signage system according to claim 14, characterized in that said housing is further provided with a relay sensor switch to allow for alternate operation of the auxiliary motor sections at a pre-selected interval of time.

16. A dynamic display signage system according to claim 11, characterized in that said spool section comprising a spool member having a shaft extending to said auxiliary motor section, said spool member having means to secure the lower portion of said display panel, and at least a pair of guide rollers adapted to feed said display panel from said spool member towards said slot portion of said top wall.

17. A dynamic display signage system according to claim 11, characterized in that said supporting means comprising first motor and a second motor, said first motor directly coupled to said second motor and having an independent counter motion with respect to said primary drive means, said second motor being further coupled to a spool member shaft to provide said display panel said independent motion with respect to said primary drive means at a preselected time, and a cooling system provided within said auxiliary motor section.

18. A dynamic display signage system according to claim 10, characterized in that said independent motion is an continuous counter pulling motion when said display panel is upwardly displaced and said independent motion is a downward vertical motion when said display panel is downwardly displaced, said downward vertical motion is faster than the applied motion of said primary drive means on said display panel.

* * * * *